US006543997B2

(12) United States Patent
Donnaruma et al.

(10) Patent No.: US 6,543,997 B2
(45) Date of Patent: Apr. 8, 2003

(54) INLET GUIDE VANE FOR AXIAL COMPRESSOR

(75) Inventors: Anthony Donnaruma, Simpsonville, SC (US); David Allen Eldredge, Simpsonville, SC (US); Joseph Anthony Cotroneo, Clifton Park, NY (US); Steven Mark Schirle, Anderson, SC (US)

(73) Assignee: General Electric Co., Schenectady, NY (US)

( * ) Notice: Subject to any disclaimer, the term of this patent is extended or adjusted under 35 U.S.C. 154(b) by 0 days.

(21) Appl. No.: 09/903,862

(22) Filed: Jul. 13, 2001

(65) Prior Publication Data

US 2003/0012645 A1 Jan. 16, 2003

(51) Int. Cl.[7] ..... F04D 29/44
(52) U.S. Cl. ..... 415/208.1; 415/191; 416/DIG. 2
(58) Field of Search ..... 415/191, 192, 415/193, 208.1, 208.2, 208.3, 209.1; 416/DIG. 2

(56) References Cited

U.S. PATENT DOCUMENTS 4,981,414 A * 1/1991 Sheets ..... 415/149.1
5,152,661 A * 10/1992 Sheets ..... 415/84
5,368,440 A * 11/1994 Japikse et al. ..... 415/208.3
5,947,680 A * 9/1999 Harada et al. ..... 415/17

OTHER PUBLICATIONS

Jul. 10, 1986 Internal GE memo with attached Inlet Guide Vane Reference Angles table.
Jan. 20, 1988 Internal GE memo with attached Inlet Guide Vanes for Heavy Duty Gas Turbines table.

* cited by examiner

*Primary Examiner*—Edward K. Look
*Assistant Examiner*—James M McAleenan
(74) *Attorney, Agent, or Firm*—Hunton & Williams

(57) ABSTRACT

An blade row for use in a compressor is provided. The blade row has a plurality of inlet guide vanes. Each inlet guide vane has a meanline approximately equal to NACA standard A4K6 meanline, a thickness distribution approximately equal to NACA standard SR 63 thickness distribution, a stagger angle, and a lift coefficient between 0.0 and 0.8.

36 Claims, 21 Drawing Sheets

```
$A
NAME=12HA-A,
SECTYP=36HNOMINAL INPUT SECTION,
SRFNRM=0,
SECHGT= 24.1860,
SECFIT=1,0,
SECMOD=100,
NCOORD/COORD=
-1.558807,  .132762, -1.652875,  .124628, -1.746932,  .116359, -1.840976,  .107945,
-1.935009,  .099408, -2.029025,  .090684, -2.123019,  .081732, -2.213859,  .072860,
-2.301555,  .064178, -2.386114,  .055754, -2.467537,  .047593, -2.545823,  .039705,
-2.620974,  .032091, -2.692992,  .024783, -2.758750,  .018120, -2.818246,  .012108,
-2.871476,  .006699, -2.918433,  .001816, -2.959113, -.002564, -2.993515, -.006448,
-3.022892, -.009941, -3.047552, -.013098, -3.067795, -.016031, -3.083919, -.018785,
-3.096173, -.021662, -3.105194, -.024449, -3.112423, -.027537, -3.117455, -.031269,
-3.119639, -.035388, -3.119376, -.040109, -3.116363, -.045671, -3.110602, -.051128,
-3.102568, -.056281, -3.091114, -.061816, -3.075660, -.067713, -3.055951, -.073976,
-3.031657, -.080386, -3.002443, -.086796, -2.968050, -.093246, -2.927149, -.099457,
-2.879773, -.105304, -2.825919, -.110473, -2.765616, -.114891, -2.698876, -.118346,
-2.625711, -.120611, -2.549340, -.121560, -2.469779, -.121124, -2.387054, -.119320,
-2.301188, -.116122, -2.212197, -.111483, -2.120109, -.105364, -2.024947, -.097645,
-1.929901, -.088603, -1.834976, -.078364, -1.740172, -.067069, -1.645491, -.054775,
-1.550935, -.041560, -1.456502, -.027491, -1.362190, -.012634, -1.267991,  .002930,
-1.173901,  .019135, -1.079913,  .035920, -.986015,  .053204, -.895322,  .070313,
-.807820,  .087170, -.723492,  .103675, -.642323,  .119754, -.564299,  .135326,
-.489407,  .150328, -.417640,  .164732, -.352107,  .177851, -.292801,  .189646,
-.239716,  .200091, -.192869,  .209271, -.152265,  .217210, -.117907,  .223928,
-.088545,  .229651, -.063864,  .234439, -.043554,  .238352, -.027304,  .241471,
-.014804,  .243863, -.006251,  .247861, -.001445,  .254123,  .000200,  .260238,
.000000,  .264995, -.001400,  .269490, -.004954,  .274648, -.011487,  .278926,
-.020773,  .279910, -.033207,  .277952, -.049378,  .275442, -.069602,  .272373,
-.094196,  .268729, -.123484,  .264544, -.157789,  .259891, -.198388,  .254813,
-.245280,  .249346, -.298467,  .243529, -.357940,  .237287, -.423697,  .230623,
-.495746,  .223635, -.570954,  .216602, -.649317,  .209510, -.730832,  .202332,
-.815495,  .195032, -.903307,  .187601, -.994262,  .179999, -1.088357,  .172185,
-1.182454,  .164385, -1.276549,  .156564, -1.370642,  .148708, -1.464729,  .140784,
THKMAX=  .187976,
LEPNT= -3.119639, -.035388,
TEPNT=  .000000,  .264995,
NMLN/MLNPTS=
-3.119639, -.035388, -3.015399, -.045407, -2.910887, -.049688, -2.806200, -.049425,
-2.701561, -.047324, -2.596966, -.043504, -2.492430, -.038352, -2.387956, -.032094,
-2.283545, -.024837, -2.179199, -.016716, -2.074916, -.007827, -1.970694,  .001758,
-1.866532,  .011965, -1.762427,  .022746, -1.658378,  .034053, -1.554383,  .045836,
-1.450438,  .058064, -1.346543,  .070704, -1.242694,  .083722, -1.138891,  .097095,
-1.035129,  .110790, -.931408,  .124782, -.827725,  .139061, -.724081,  .153618,
```

Fig. 5A

```
-.620475,  .168440, -.516905,  .183516, -.413373,  .198850, -.309885,  .214481,
-.206441,  .230402, -.103133,  .247160, .000001,  .264995,
$
$A
NAME=12HB-B
SECTYP=36HNOMINAL INPUT SECTION          ,
SRFNRM=0,
SECHGT=  25.2390,
SECFIT=1,0,
SECMOD=100,
NCOORD/COORD=
-1.626867,  .126641, -1.725044,  .118144, -1.823208,  .109508, -1.921359,  .100724,
-2.019499,  .091813, -2.117620,  .082708, -2.215721,  .073370, -2.310529,  .064118,
-2.402056,  .055062, -2.490309,  .046276, -2.575288,  .037764, -2.656995,  .029537,
-2.735428,  .021597, -2.810593,  .013976, -2.879223,  .007029, -2.941318,  .000759,
-2.996874, -.004881, -3.045882, -.009972, -3.088339, -.014537, -3.124244, -.018586,
-3.154905, -.022226, -3.180643, -.025516, -3.201771, -.028570, -3.218601, -.031437,
-3.231391, -.034436, -3.240804, -.037348, -3.248349, -.040570, -3.253608, -.044457,
-3.255895, -.048751, -3.255625, -.053678, -3.252489, -.059488, -3.246487, -.065194,
-3.238107, -.070580, -3.226157, -.076366, -3.210032, -.082533, -3.189466, -.089083,
-3.164115, -.095788, -3.133627, -.102493, -3.097734, -.109237, -3.055046, -.115728,
-3.005601, -.121837, -2.949394, -.127233, -2.886456, -.131841, -2.816799, -.135440,
-2.740436, -.137791, -2.660727, -.138763, -2.577689, -.138287, -2.491350, -.136381,
-2.401732, -.133019, -2.308854, -.128153, -2.212742, -.121743, -2.113424, -.113662,
-2.014226, -.104202, -1.915156, -.093495, -1.816210, -.081692, -1.717393, -.068850,
-1.618706, -.055047, -1.520148, -.040354, -1.421715, -.024843, -1.323401, -.008597,
-1.225200,  .008320, -1.127104,  .025840, -1.029103,  .043882, -.934447,  .061742,
-.843122,  .079338, -.755109,  .096567, -.670395,  .113352, -.588962,  .129610,
-.510798,  .145272, -.435896,  .160311, -.367501,  .174010, -.305604,  .186328,
-.250201,  .197236, -.201308,  .206824, -.158931,  .215115, -.123073,  .222134,
-.092428,  .228114, -.066670,  .233117, -.045474,  .237206, -.028514,  .240465,
-.015468,  .242964, -.006535,  .247121, -.001511,  .253651,  .000209,  .260032,
.000000,  .264996, -.001463,  .269687, -.005175,  .275066, -.011997,  .279521,
-.021690,  .280531, -.034667,  .278482, -.051543,  .275859, -.072649,  .272651,
.098317,  .268840, -.128882,  .264464, -.164685,  .259597, -.207055,  .254288,
-.255994,  .248571, -.311502,  .242486, -.373571,  .235956, -.442198,  .228984,
-.517393,  .221674, -.595884,  .214317, -.677668,  .206896, -.762741,  .199385,
-.851101,  .191748, -.942746,  .183974, -1.037672,  .176020, -1.135876,  .167847,
-1.234081,  .159690, -1.332285,  .151513, -1.430486,  .143303, -1.528681,  .135023,
THKMAX=  .195989,
LEPNT= -3.255895, -.048751,
TEPNT=  .000000,  .264996,
NMLN/MLNPTS=
-3.255895, -.048751, -3.147105, -.059265, -3.038028, -.063761, -2.928767, -.063493,
-2.819556, -.061300, -2.710391, -.057307, -2.601288, -.051920, -2.492250, -.045376,
```

Fig. 5B

-2.383279, -.037791, -2.274374, -.029304, -2.165536, -.020016, -2.056761, -.010001,
-1.948049, .000664, -1.839397, .011926, -1.730802, .023736, -1.622264, .036045,
-1.513779, .048816, -1.405345, .062017, -1.296960, .075612, -1.188622, .089578,
-1.080329, .103883, -.972077, .118499, -.863866, .133414, -.755696, .148620,
-.647565, .164105, -.539472, .179855, -.431419, .195876, -.323413, .212208,
-.215452, .228844, -.107633, .246356, .000002, .264997,
$
$A
NAME=12HC-C ,
SECTYP=36HNOMINAL INPUT SECTION ,
SRFNRM=0,
SECHGT= 26.2910,
SECFIT=1,0,
SECMOD=100,
NCOORD/COORD=
-1.694422, .119539, -1.796678, .110631, -1.898922, .101590, -2.001153, .092405,
-2.103374, .083099, -2.205576, .073605, -2.307757, .063882, -2.406512, .054263,
-2.501849, .044861, -2.593777, .035746, -2.682296, .026926, -2.767408, .018412,
-2.849111, .010210, -2.927410, .002350, -2.998903, -.004802, -3.063590, -.011246,
-3.121466, -.017035, -3.172522, -.022250, -3.216754, -.026917, -3.254163, -.031047,
-3.286109, -.034755, -3.312928, -.038100, -3.334946, -.041205, -3.352490, -.044110,
-3.365831, -.047155, -3.375659, -.050112, -3.383552, -.053389, -3.389081, -.057367,
-3.391497, -.061819, -3.391175, -.066945, -3.387820, -.072946, -3.381497, -.078813,
-3.372726, -.084355, -3.360242, -.090299, -3.343415, -.096631, -3.321970, -.103365,
-3.295541, -.110247, -3.263770, -.117135, -3.226371, -.124058, -3.181899, -.130713,
-3.130392, -.136968, -3.071848, -.142489, -3.006296, -.147191, -2.933748, -.150845,
-2.854220, -.153207, -2.771209, -.154148, -2.684731, -.153592, -2.594817, -.151558,
-2.501488, -.148018, -2.404765, -.142923, -2.304674, -.136230, -2.201241, -.127812,
-2.097934, -.117971, -1.994757, -.106848, -1.891709, -.094593, -1.788792, -.081266,
-1.686010, -.066949, -1.583360, -.051714, -1.480837, -.035635, -1.378437, -.018796,
-1.276154, -.001266, -1.173979, .016890, -1.071901, .035584, -.973307, .054089,
-.878181, .072321, -.786506, .090172, -.698265, .107567, -.613443, .124418,
-.532026, .140654, -.454008, .156247, -.382768, .170455, -.318297, .183231,
-.260591, .194549, -.209666, .204501, -.165529, .213110, -.128182, .220401,
-.096266, .226617, -.069439, .231817, -.047363, .236068, -.029701, .239457,
-.016113, .242056, -.006808, .246382, -.001575, .253181, .000217, .259826,
.000000, .264996, -.001523, .269881, -.005391, .275483, -.012499, .280121,
-.022594, .281169, -.036110, .279031, -.053687, .276293, -.075671, .272944,
-.102404, .268965, -.134239, .264393, -.171529, .259306, -.215659, .253751,
-.266630, .247764, -.324443, .241383, -.389088, .234530, -.460564, .227209,
-.538880, .219526, -.620629, .211789, -.705808, .203980, -.794413, .196072,
-.886441, .188029, -.981890, .179839, -1.080757, .171460, -1.183038, .162853,
-1.285322, .154267, -1.387603, .145666, -1.489883, .137033, -1.592157, .128334,

Fig. 5C

```
THKMAX=  .201033,
LEPNT= -3.391497,  -.061819,
TEPNT=  .000000,  .264996,
NMLN/MLNPTS=
-3.391497,  -.061819, -3.278173,  -.072740, -3.164553,  -.077407, -3.050742,  -.077123,
-2.936983,  -.074835, -2.823272,  -.070676, -2.709626,  -.065068, -2.596047,  -.058254,
-2.482537,  -.050356, -2.369097,  -.041520, -2.255725,  -.031850, -2.142420,  -.021422,
-2.029180,  -.010316, -1.916003,  .001411, -1.802886,  .013709, -1.689827,  .026527,
-1.576824,  .039828, -1.463874,  .053577, -1.350975,  .067736, -1.238126,  .082282,
-1.125322,  .097180, -1.012562,  .112403,  -.899844,  .127938,  -.787169,  .143776,
-.674534,  .159905, -.561940,  .176309,  -.449387,  .192997,  -.336883,  .210009,
-.224426,  .227337,  -.112117,  .245579, .000000,  .264996,
$
$A
NAME=12HD-D        ,
SECTYP=36HNOMINAL INPUT SECTION              ,
SRFNRM=0,
SECHGT=  28.3970,
SECFIT=1,0,
SECMOD=100,
NCOORD/COORD=
-1.829384,  .103484, -1.939793,  .093682, -2.050192,  .083770, -2.160582,  .073743,
-2.270962,  .063621, -2.381327,  .053341, -2.491675,  .042866, -2.598325,  .032547,
-2.701289,  .022497, -2.800575,  .012789, -2.896182,  .003427, -2.988112,  -.005573,
-3.076365,  -.014201, -3.160947,  -.022425, -3.238180,  -.029864, -3.308063,  -.036534,
-3.370591,  -.042494, -3.425755,  -.047828, -3.473552,  -.052573, -3.513980,  -.056744,
-3.548510,  -.060472, -3.577505,  -.063813, -3.601316,  -.066912, -3.620306,  -.069782,
-3.634771,  -.072807, -3.645455,  -.075754, -3.654087,  -.079022, -3.660226,  -.083075,
-3.662954,  -.087803, -3.662466,  -.093315, -3.658557,  -.099622, -3.651499,  -.105697,
-3.641897,  -.111460, -3.628300,  -.117616, -3.610030,  -.124158, -3.586798,  -.131145,
-3.558188,  -.138254, -3.523832,  -.145384, -3.483407,  -.152531, -3.435357,  -.159376,
-3.379723,  -.165786, -3.316505,  -.171428, -3.245731,  -.176187, -3.167413,  -.179823,
-3.081568,  -.182087, -2.991969,  -.182857, -2.898633,  -.182054, -2.801589,  -.179689,
-2.700862,  -.175731, -2.596471,  -.170127, -2.488444,  -.162834, -2.376809,  -.153725,
-2.265303,  -.143133, -2.153933,  -.131203, -2.042696,  -.118089, -1.931596,  -.103855,
-1.820634,  -.088587, -1.709808,  -.072360, -1.599114,  -.055252, -1.488547,  -.037347,
-1.378100,  -.018715, -1.267766,  .000574, -1.157531,  .020428, -1.051055,  .040076,
-.948321,  .059432, -.849313,  .078390,  -.754013,  .096865,  -.662407,  .114770,
-.574479,  .132032,  -.490223,  .148619, -.413289,  .163738,  -.343668,  .177343,
-.281353,  .189406,  -.226365,  .200024,  -.178708,  .209222, -.138385,  .217022,
-.103927,  .223678,  -.074964,  .229252,  -.051132,  .233812,  -.032064,  .237449,
-.017396,  .240240,  -.007352,  .244906,  -.001702,  .252243,  .000234,  .259416,
.000000,  .264995, -.001645,  .270272,  -.005825,  .276322,  -.013503,  .281327,
-.024408,  .282450,  -.039002,  .280130, -.057981,  .277159,  -.081717,  .273521,
-.110582,  .269194,  -.144955,  .264217,  -.185216,  .258666, -.232861,  .252585,
-.287891,  .246010,  -.350307,  .238982,  -.420099,  .231412,  -.497265,  .223307,
```

Fig. 5D

-.581816, .214782, -.670072, .206180, -.762031, .197482, -.857689, .188660,
-.957043, .179676, -1.060091, .170524, -1.166830, .161165, -1.277257, .151557,
-1.387686, .141986, -1.498115, .132417, -1.608543, .122827, -1.718967, .113191,
THKMAX= .206690,
LEPNT= -3.662954, -.087803,
TEPNT= .000000, .264995,
NMLN/MLNPTS=
-3.662954, -.087803, -3.540555, -.099526, -3.417840, -.104533, -3.294922, -.104219,
-3.172059, -.101746, -3.049248, -.097258, -2.926506, -.091208, -2.803837, -.083859,
-2.681242, -.075340, -2.558723, -.065808, -2.436278, -.055376, -2.313904, -.044126,
-2.191600, -.032144, -2.069364, -.019490, -1.947194, -.006216, -1.825086, .007619,
-1.703038, .021974, -1.581048, .036814, -1.459114, .052100, -1.337232, .067801,
-1.215400, .083881, -1.093614, .100313, -.971874, .117080, -.850180, .134174,
-.728530, .151581, -.606923, .169287, -.485361, .187298, -.363851, .205658,
-.242392, .224359, -.121093, .244044, .000000, .264995,
$
$A
NAME=12HE-E ,
SECTYP=36HNOMINAL INPUT SECTION ,
SRFNRM=0,
SECHGT= 30.5020,
SECFIT=1,0,
SECMOD=100,
NCOORD/COORD=
-1.964578, .087362, -2.083157, .076670, -2.201729, .065894, -2.320292, .055031,
-2.438850, .044099, -2.557395, .033043, -2.675926, .021825, -2.790489, .010814,
-2.901096, .000121, -3.007755, -.010175, -3.110465, -.020074, -3.209227, -.029559,
-3.304044, -.038615, -3.394918, -.047209, -3.477901, -.054943, -3.552989, -.061847,
-3.620177, -.067986, -3.679456, -.073447, -3.730821, -.078278, -3.774273, -.082500,
-3.811388, -.086257, -3.842559, -.089605, -3.868166, -.092704, -3.888598, -.095549,
-3.904183, -.098564, -3.915716, -.101521, -3.925073, -.104797, -3.931820, -.108912,
-3.934877, -.113902, -3.934225, -.119798, -3.929783, -.126412, -3.922026, -.132726,
-3.911612, -.138736, -3.896919, -.145137, -3.877220, -.151932, -3.852211, -.159211,
-3.821429, -.166591, -3.784491, -.174004, -3.741040, -.181418, -3.689411, -.188493,
-3.629644, -.195095, -3.561743, -.200883, -3.485734, -.205720, -3.401633, -.209353,
-3.309453, -.211525, -3.213248, -.212119, -3.113035, -.211053, -3.008843, -.208337,
-2.900698, -.203938, -2.788620, -.197796, -2.672637, -.189869, -2.552778, -.180034,
-2.433054, -.168655, -2.313472, -.155883, -2.194028, -.141879, -2.074725, -.126709,
-1.955564, -.110465, -1.836544, -.093221, -1.717660, -.075060, -1.598905, -.056071,
-1.480275, -.036320, -1.361761, -.015882, -1.243350, .005147, -1.128972, .025950,
-1.018613, .046443, -.912254, .066517, -.809878, .086083, -.711470, .105048,
-.617014, .123341, -.526504, .140924, -.443861, .156960, -.369075, .171396,
-.302141, .184207, -.243078, .195495, -.191892, .205285, -.148585, .213596,
-.111578, .220695, -.080474, .226645, -.054880, .231515, -.034403, .235402,
-.018652, .238386, -.007877, .243418, -.001821, .251304, .000252, .259007,
.000000, .264998, -.001766, .270665, -.006251, .277166, -.014492, .282552,

Fig. 5E

-.026203, .283773, -.041878, .281275, -.062262, .278068, -.087754, .274139,
-.118755, .269462, -.155669, .264074, -.198907, .258055, -.250074, .251442,
-.309170, .244271, -.376199, .236587, -.451146, .228294, -.534012, .219397,
-.624808, .210021, -.719584, .200546, -.818335, .190949, -.921060, .181203,
-1.027753, .171271, -1.138414, .161150, -1.253040, .150804, -1.371626, .140191,
-1.490217, .129632, -1.608810, .119093, -1.727402, .108549, -1.845992, .097979,
THKMAX= .212684,
LEPNT= -3.934877, -.113902,
TEPNT= .000000, .264998,
NMLN/MLNPTS=
-3.934877, -.113902, -3.803395, -.126522, -3.671571, -.131920, -3.539527, -.131596,
-3.407543, -.128942, -3.275615, -.124121, -3.143762, -.117620, -3.011986, -.109724,
-2.880291, -.100570, -2.748677, -.090328, -2.617142, -.079119, -2.485684, -.067030,
-2.354301, -.054156, -2.222991, -.040560, -2.091752, -.026299, -1.960580, -.011435,
-1.829472, .003986, -1.698426, .019928, -1.567439, .036348, -1.436509, .053215,
-1.305633, .070488, -1.174806, .088138, -1.044029, .106148, -.913300, .124509,
-.782619, .143206, -.651984, .162221, -.521397, .181563, -.390866, .201280,
-.260390, .221362, -.130084, .242501, .000000, .264998,
$
$A
NAME=12HF-F ,
SECTYP=36HNOMINAL INPUT SECTION ,
SRFNRM=0,
SECHGT= 32.6080,
SECFIT=1,0,
SECMOD=100,
NCOORD/COORD=
-2.099814, .072095, -2.226561, .060554, -2.353301, .048944, -2.480034, .037264,
2.606764, .025537, -2.733483, .013707, -2.860191, .001737, -2.982660, -.009981,
-3.100902, -.021335, -3.214924, -.032248, -3.324727, -.042717, -3.430313, -.052722,
-3.531684, -.062247, -3.628841, -.071256, -3.717563, -.079337, -3.797847, -.086529,
-3.869685, -.092900, -3.933070, -.098542, -3.987996, -.103510, -4.034461, -.107834,
-4.074154, -.111669, -4.107494, -.115074, -4.134886, -.118220, -4.156752, -.121092,
-4.173442, -.124150, -4.185817, -.127122, -4.195916, -.130337, -4.203193, -.134622,
-4.206471, -.139945, -4.205675, -.146225, -4.200747, -.153170, -4.192329, -.159759,
-4.181126, -.166053, -4.165358, -.172738, -4.144248, -.179833, -4.117476, -.187448,
-4.084536, -.195149, -4.045027, -.202892, -3.998560, -.210622, -3.943360, -.217982,
-3.879468, -.224833, -3.806890, -.230819, -3.725651, -.235787, -3.635768, -.239472,
-3.537257, -.241607, -3.434447, -.242076, -3.327357, -.240792, -3.216016, -.237763,
-3.100452, -.232954, -2.980686, -.226303, -2.856746, -.217766, -2.728662, -.207219,
-2.600721, -.195056, -2.472926, -.181439, -2.345277, -.166526, -2.217775, -.150397,
-2.090420, -.133145, -1.963212, -.114843, -1.836144, -.095583, -1.709212, -.075458,
-1.582409, -.054531, -1.455727, -.032883, -1.329152, -.010615, -1.206885, .011410,
-1.088913, .033106, -.975216, .054358, -.865776, .075073, -.760577, .095157,
-.659605, .114533, -.562851, .133161, -.474508, .150155, -.394564, .165459,

Fig. 5F

-.323016, .179047, -.259883, .191029, -.205171, .201426, -.158883, .210262,
-.119329, .217814, -.086085, .224147, -.058730, .229332, -.036846, .233472,
-.020011, .236651, -.008468, .241965, -.001966, .250368, .000265, .258595,
.000000, .264997, -.001891, .271056, -.006699, .277996, -.015530, .283722,
-.028055, .284961, -.044809, .282277, -.066597, .278840, -.093846, .274627,
-.126982, .269607, -.166437, .263820, -.212652, .257348, -.267340, .250224,
-.330503, .242487, -.402144, .234180, -.482247, .225203, -.570813, .215562,
-.667855, .205389, -.769150, .195096, -.874694, .184661, -.984484, .174055,
-1.098516, .163242, -1.216790, .152221, -1.339302, .140956, -1.466047, .129405,
-1.592799, .117923, -1.719553, .106475, -1.846309, .095034, -1.973063, .083581,
THKMAX= .220521,
LEPNT= -4.206471, -.139945,
TEPNT= .000000, .264997,
NMLN/MLNPTS=
-4.206471, -.139945, -4.065915, -.153450, -3.924993, -.159235, -3.783836, -.158899,
-3.642743, -.156064, -3.501709, -.150911, -3.360755, -.143964, -3.219885, -.135522,
-3.079100, -.125735, -2.938401, -.114785, -2.797788, -.102801, -2.657257, -.089878,
-2.516807, -.076114, -2.376434, -.061577, -2.236137, -.046331, -2.095911, -.030443,
-1.955754, -.013955, -1.815664, .003088, -1.675636, .020640, -1.535669, .038668,
-1.395759, .057133, -1.255903, .075999, -1.116099, .095250, -.976347, .114875,
-.836646, .134857, -.696994, .155179, -.557392, .175848, -.417851, .196916,
-.278367, .218375, -.139067, .240961, -.000001, .264997,
$
$A
NAME=12HG-G ,
SECTYP=36HNOMINAL INPUT SECTION ,
SRFNRM=0,
SECHGT= 34.7130,
SECFIT=1,0,
SECMOD=100,
NCOORD/COORD=
-2.234828, .057862, -2.369723, .045511, -2.504612, .033100, -2.639495, .020628,
-2.774376, .008118, -2.909247, -.004483, -3.044106, -.017212, -3.174457, -.029655,
-3.300311, -.041698, -3.421674, -.053261, -3.538548, -.064339, -3.650934, -.074911,
-3.758835, -.084959, -3.862252, -.094446, -3.956692, -.102937, -4.042150, -.110479,
-4.118620, -.117147, -4.186093, -.123036, -4.244564, -.128208, -4.294029, -.132697,
-4.336286, -.136670, -4.371781, -.140188, -4.400948, -.143434, -4.424233, -.146389,
-4.442015, -.149544, -4.455207, -.152621, -4.465991, -.155931, -4.473802, -
.160379, -4.477349, -.166003, -4.476442, -.172673, -4.471091, -.179987, -4.462057,
-.186904,
-4.450093, -.193528, -4.433275, -.200552, -4.410777, -.208003, -4.382259, -.216012,
-4.347180, -.224102, -4.305116, -.232240, -4.255649, -.240356, -4.196890, -.248072,
-4.128886, -.255241, -4.051641, -.261498, -3.965182, -.266668, -3.869525, -.270473,
3.764691, -.272633, -3.655282, -.273033, -3.541321, -.271580, -3.422837, -.268281,
-3.299860, -.263097, -3.172410, -.255965, -3.040520, -.246840, -2.904219, -.235593,
-2.768067, -.222645, -2.632070, -.208169, -2.496225, -.192330, -2.360535, -.175210,

Fig. 5G

-2.224999, -.156909, -2.089618, -.137502, -1.954384, -.117087, -1.819291, -.095761,
-1.684335, -.073590, -1.549505, -.050659, -1.414788, -.027075, -1.284655, -.003747,
-1.159092, .019230, -1.038078, .041735, -.921595, .063676, -.809627, .084951,
-.702157, .105479, -.599178, .125218, -.505150, .143224, -.420064, .159445,
-.343914, .173852, -.276722, .186559, -.218493, .197591, -.169229, .206970,
-.127133, .214988, -.091754, .221713, -.062642, .227221, -.039351, .231619,
-.021435, .234997, -.009101, .240538, -.002128, .249437, .000275, .258183,
.000000, .264996, -.002019, .271443, -.007160, .278814, -.016598, .284849,
-.029941, .286038, -.047772, .283179, -.070961, .279516, -.099961, .275024,
-.135227, .269672, -.177219, .263498, -.226404, .256589, -.284607, .248978,
-.351829, .240704, -.428073, .231813, -.513324, .222198, -.607580, .211868,
-.710857, .200958, -.818659, .189912, -.930984, .178708, -1.047828, .167316,
-1.169186, .155700, -1.295059, .143857, -1.425441, .131750, -1.560331, .119342,
-1.695227, .107011, -1.830127, .094722, -1.965028, .082444, -2.099929, .070164,
THKMAX= .230684,
LEPNT= -4.477349, -.166003,
TEPNT= .000000, .264996,
NMLN/MLNPTS=
-4.477349, -.166003, -4.327744, -.180400, -4.177747, -.186570, -4.027500, -.186217,
-3.877321, -.183201, -3.727205, -.177716, -3.577174, -.170319, -3.427232, -.161331,
-3.277382, -.150910, -3.127623, -.139251, -2.977955, -.126492, -2.828375, -.112733,
-2.678880, -.098078, -2.529468, -.082602, -2.380136, -.066371, -2.230880, -.049456,
-2.081698, -.031905, -1.932586, -.013762, -1.783542, .004924, -1.634562, .024116,
-1.485642, .043770, -1.336779, .063852, -1.187972, .084343, -1.039220, .105231,
-.890523, .126500, -.741877, .148130, -.593285, .170127, -.444757, .192546,
-.296291, .215383, -.148019, .239420, .000001, .264997,
$
$A
NAME=12HH-H ,
SECTYP=36HNOMINAL INPUT SECTION ,
SRFNRM=0,
SECHGT= 36.8180,
SECFIT=1,0,
SECMOD=100,
NCOORD/COORD=
-2.370909, .052567, -2.514049, .039679, -2.657179, .026684, -2.800298, .013575,
-2.943411, .000386, -3.086508, -.012966, -3.229585, -.026531, -3.367872, -.039862,
-3.501383, -.052818, -3.630125, -.065305, -3.754101, -.077319, -3.873311, -.088843,
-3.987756, -.099865, -4.097441, -.110344, -4.197599, -.119794, -4.288229, -.128238,
-4.369322, -.135753, -4.440868, -.142451, -4.502862, -.148387, -4.555303, -.153582,
-4.600096, -.158210, -4.637713, -.162342, -4.668612, -.166165, -4.693264, -.169689,
-4.712058, -.173422, -4.725973, -.177017, -4.737281, -.180929, -4.745307, -.186073,
-4.748852, -.192197, -4.748137, -.199328, -4.742891, -.207390, -4.733599, -.215100,
-4.721067, -.222427, -4.703372, -.230253, -4.679629, -.238568, -4.649466, -.247463,

Fig. 5H

-4.612334, -.256493, -4.567762, -.265559, -4.515326, -.274633, -4.453012, -.283308,
-4.380872, -.291411, -4.298906, -.298518, -4.207149, -.304476, -4.105618, -.308983,
-3.994334, -.311715, -3.878186, -.312523, -3.757199, -.311306, -3.631407, -.308083,
-3.500843, -.302815, -3.365529, -.295437, -3.225502, -.285895, -3.080797, -.274027,
-2.936256, -.260277, -2.791887, -.244837, -2.647685, -.227908, -2.503654, -.209571,
-2.359796, -.189932, -2.216108, -.169084, -2.072584, -.147125, -1.929219, -.124162,
-1.786002, -.100285, -1.642926, -.075581, -1.499976, -.050162, -1.361894, -.025014,
-1.228664, -.000242, -1.100261, .024018, -.976668, .047663, -.857864, .070580,
-.743831, .092677, -.634561, .113915, -.534788, .133283, -.444500, .150717,
-.363691, .166186, -.292386, .179816, -.230588, .191634, -.178304, .201666,
-.133624, .210234, -.096072, .217413, -.065172, .223290, -.040451, .227980,
-.021461, .231705, -.008856, .238580, -.001947, .248407, .000351, .257765,
.000000, .264997, -.002086, .271855, -.007328, .279826, -.017001, .286745,
-.031019, .289109, -.049959, .286244, -.074565, .282375, -.105337, .277634,
-.142760, .271992, -.187320, .265491, -.239514, .258229, -.301278, .250250,
-.372615, .241602, -.453527, .232340, -.543999, .222350, -.644030, .211634,
-.753635, .200339, -.868041, .188922, -.987247, .177361, -1.111249, .165623,
-1.240042, .153664, -1.373624, .141477, -1.511992, .129013, -1.655141, .116228,
-1.798295, .103506, -1.941452, .090808, -2.084608, .078105, -2.227762, .065368,
THKMAX= .260582,
LEPNT= -4.748852, -.192197,
TEPNT= .000000, .264997,
NMLN/MLNPTS=
-4.748852, -.192197, -4.590177, -.207493, -4.431085, -.214045, -4.271726, -.213667,
-4.112440, -.210467, -3.953221, -.204645, -3.794092, -.196794, -3.635058, -.187255,
-3.476120, -.176198, -3.317281, -.163827, -3.158537, -.150288, -2.999887, -.135688,
-2.841326, -.120140, -2.682855, -.103722, -2.524467, -.086504, -2.366161, -.068560,
-2.207932, -.049942, -2.049779, -.030695, -1.891696, -.010873, -1.733682, .009486,
-1.575732, .030336, -1.417843, .051639, -1.260012, .073375, -1.102240, .095531,
-.944526, .118092, -.786866, .141035, -.629264, .164368, -.471729, .188149,
-.314260, .212373, -.156997, .237868, .000000, .264997,
$
$A
NAME=12HJ-J ,
SECTYP=36HNOMINAL INPUT SECTION ,
SRFNRM=0,
SECHGT= 38.9240,
SECFIT=1,0,
SECMOD=100,
NCOORD/COORD=
-2.508656, .059556, -2.660180, .046504, -2.811685, .033225, -2.963168, .019700,
-3.114631, .005960, -3.266065, -.008107, -3.417460, -.022578, -3.563769, -.036982,
-3.705008, -.051137, -3.841189, -.064927, -3.972313, -.078337, -4.098381, -.091350,
-4.219393, -.103962, -4.335357, -.116120, -4.441233, -.127257, -4.537022, -.137359,
-4.622719, -.146494, -4.698308, -.154782, -4.763787, -.162250, -4.819152, -.168911,
-4.866423, -.174925, -4.906092, -.180391, -4.938644, -.185471, -4.964547, -.190283,

Fig. 5I

-4.984195, -.195284, -4.998644, -.200035, -5.010173, -.205256, -5.017964, -.211660,
-5.021259, -.218430, -5.020998, -.226056, -5.016514, -.235212, -5.007540, -.244321,
-4.994789, -.252923, -4.976501, -.262188, -4.951747, -.272077, -4.920102, -.282545,
-4.881069, -.293306, -4.834077, -.304047, -4.778734, -.314879, -4.712885, -.325341,
-4.636591, -.335227, -4.549840, -.344002, -4.452688, -.351564, -4.345149, -.357560,
-4.227245, -.361613, -4.104166, -.363499, -3.975939, -.363106, -3.842611, -.360462,
-3.704216, -.355528, -3.560786, -.348224, -3.412363, -.338481, -3.258991, -.326091,
-3.105809, -.311523, -2.952826, -.295000, -2.800038, -.276764, -2.647451, -.256904,
-2.495068, -.235543, -2.342885, -.212797, -2.190899, -.188773, -2.039098, -.163601,
-1.887474, -.137391, -1.736016, -.110236, -1.584705, -.082266, -1.438561, -.054578,
-1.297560, -.027299, -1.161673, -.000592, -1.030878, .025421, -.905149, .050612,
-.784465, .074875, -.668817, .098167, -.563214, .119375, -.467643, .138434,
-.382097, .155311, -.306602, .170141, -.241167, .182959, -.185797, .193798,
-.138477, .203032, -.098701, .210752, -.065969, .217061, -.039780, .222089,
-.019912, .226962, -.007777, .236225, -.001456, .247301, .000486, .257336,
.000000, .264999, -.002101, .272292, -.007226, .280999, -.016745, .289265,
-.031072, .294007, -.051186, .292038, -.077232, .287991, -.109807, .283044,
-.149422, .277173, -.196597, .270430, -.251854, .262940, -.317249, .254771,
-.392783, .245989, -.478458, .236664, -.574260, .226670, -.680184, .216009,
-.796247, .204835, -.917395, .193596, -1.043626, .182269, -1.174934, .170806,
-1.311314, .159150, -1.452764, .147285, -1.599278, .135145, -1.750851, .122663,
-1.902425, .110194, -2.053995, .097686, -2.205560, .085110, -2.357115, .072416,
THKMAX= .317412,
LEPNT= -5.021259, -.218430,
TEPNT= .000000, .264999,
NMLN/MLNPTS=
-5.021259, -.218430, -4.853483, -.234623, -4.685266, -.241542, -4.516766, -.241120,
-4.348342, -.237737, -4.179990, -.231584, -4.011733, -.223280, -3.843577, -.213193,
-3.675522, -.201501, -3.507571, -.188421, -3.339721, -.174106, -3.171970, -.158668,
-3.004315, -.142229, -2.836752, -.124872, -2.669279, -.106668, -2.501891, -.087694,
-2.334586, -.068007, -2.167361, -.047658, -2.000210, -.026700, -1.833132, -.005174,
-1.666121, .016871, -1.499174, .039396, -1.332290, .062379, -1.165468, .085807,
-.998706, .109662, -.832003, .133920, -.665361, .158591, -.498789, .183737,
-.332287, .209348, -.166003, .236307, -.000002, .264999,
$
$A
NAME=12HK-K ,
SECTYP=36HNOMINAL INPUT SECTION ,
SRFNRM=0,
SECHGT= 39.9760,
SECFIT=1,0,
SECMOD=100,
NCOORD/COORD=
-2.578636, .074313, -2.734456, .061568, -2.890245, .048468, -3.046001, .034980,
-3.201725, .021114, -3.357403, .006750, -3.513026, -.008206, -3.663398, -.023290,
-3.808541, -.038299, -3.948467, -.053095, -4.083179, -.067640, -4.212677, -.081911,

Fig. 5J

-4.336964, -.095902, -4.456045, -.109549, -4.564747, -.122218, -4.663074, -.133869,
-4.751019, -.144553, -4.828568, -.154385, -4.895719, -.163352, -4.952463, -.171481,
-5.000883, -.178890, -5.041472, -.185729, -5.074736, -.192085, -5.101101, -.198250,
-5.120958, -.204563, -5.135364, -.210636, -5.146616, -.217170, -5.154056, -.224402,
-5.157189, -.231500, -5.157290, -.239378, -5.153678, -.249242, -5.145452, -.259508,
-5.132998, -.269280, -5.114734, -.279853, -5.089753, -.291204, -5.057559, -.303107,
-5.017770, -.315506, -4.969687, -.327799, -4.912990, -.340278, -4.845430, -.352428,
-4.767080, -.364026, -4.677914, -.374427, -4.578008, -.383580, -4.467373, -.391071,
-4.346035, -.396499, -4.219342, -.399570, -4.087327, -.400161, -3.950044, -.398299,
-3.807537, -.393933, -3.659840, -.386964, -3.507008, -.377309, -3.349090, -.364731,
-3.191383, -.349718, -3.033899, -.332525, -2.876638, -.313402, -2.719607, -.292464,
-2.562809, -.269853, -2.406243, -.245695, -2.249899, -.220124, -2.093769, -.193284,
-1.937842, -.165295, -1.782105, -.136258, -1.626538, -.106323, -1.476296, -.076676,
-1.331350, -.047468, -1.191665, -.018887, -1.057216, .008934, -.927972, .035852,
-.803910, .061750, -.685018, .086574, -.576442, .109132, -.478171, .129369,
-.390200, .147258, -.312555, .162932, -.245248, .176437, -.188285, .187814,
-.139598, .197482, -.098669, .205545, -.064986, .212124, -.038035, .217359,
-.018161, .224024, -.006757, .234873, -.001040, .246709, .000586, .257113,
.000000, .265000, -.002078, .272522, -.007022, .281663, -.016206, .290822,
-.030335, .297275, -.051009, .297103, -.077791, .292993, -.111288, .287980,
-.152027, .282050, -.200541, .275260, -.257371, .267762, -.324630, .259654,
-.402321, .251016, -.490446, .241934, -.588989, .232271, -.697947, .222031,
-.817332, .211383, -.941951, .200745, -1.071796, .190086, -1.206865, .179347,
-1.347149, .168457, -1.492645, .157395, -1.643349, .146076, -1.799253, .134410,
-1.955154, .122700, -2.111045, .110877, -2.266926, .098913, -2.422791, .086746,
THKMAX= .370808,
LEPNT= -5.157189, -.231500,
TEPNT= .000000, .265000,
NMLN/MLNPTS=
-5.157189, -.231500, -4.984872, -.248146, -4.812101, -.255234, -4.639040, -.254769,
-4.466057, -.251299, -4.293147, -.244986, -4.120335, -.236460, -3.947626, -.226104,
3.775022, -.214100, -3.602524, -.200668, -3.430130, -.185971, -3.257837, -.170120,
-3.085643, -.153238, -2.913544, -.135415, -2.741537, -.116720, -2.569618, -.097233,
-2.397784, -.077016, -2.226031, -.056119, -2.054355, -.034598, -1.882754, -.012490,
-1.711222, .010150, -1.539756, .033282, -1.368354, .056886, -1.197016, .080948,
-1.025740, .105448, -.854524, .130364, -.683370, .155703, -.512288, .181530,
-.341279, .207835, -.170493, .235526, .000000, .265000,
$
$A
NAME=12HL-L ,
SECTYP=36HNOMINAL INPUT SECTION ,
SRFNRM=0,
SECHGT= 41.0290,
SECFIT=1,0,
SECMOD=100,

Fig. 5K

NCOORD/COORD=
-2.651144, .108149, -2.811476, .096454, -2.971764, .084149, -3.131997, .071173,
-3.292174, .057502, -3.452277, .042999, -3.612288, .027527, -3.766861, .011520,
-3.916016, -.004769, -4.059766, -.021170, -4.198118, -.037601, -4.331074, -.054022,
-4.458630, -.070421, -4.580797, -.086711, -4.692265, -.102146, -4.793043, -.116633,
-4.883125, -.130183, -4.962490, -.142918, -5.031141, -.154730, -5.089058, -.165663,
-5.138408, -.175736, -5.179636, -.185267, -5.213330, -.194055, -5.239696, -.202968,
-5.259174, -.211892, -5.272944, -.220173, -5.283331, -.228605, -5.289840, -
.237072, -5.292597, -.244590, -5.293170, -.252717, -5.291008, -.263352, -5.284582,
-.275297,
-5.273382, -.287142, -5.255834, -.300017, -5.231254, -.314028, -5.198928, -.328507,
-5.158859, -.343974, -5.109961, -.359095, -5.052151, -.374604, -4.983048, -.389904,
-4.902732, -.404689, -4.811147, -.418162, -4.708419, -.430329, -4.594545, -.440666,
-4.469563, -.448755, -4.338997, -.454152, -4.202892, -.456727, -4.061322, -
.456501, -3.914339, -.453401, -3.761994, -.447287, -3.604359, -.438042, -3.441498,
-.425374,
-3.278885, -.409814, -3.116542, -.391670, -2.954475, -.371201, -2.792693, -.348579,
-2.631201, -.323980, -2.469999, -.297547, -2.309075, -.269462, -2.148415, -.239910,
-1.988006, -.209026, -1.827835, -.176927, -1.667875, -.143794, -1.513414, -.110965,
-1.364414, -.078642, -1.220828, -.047050, -1.082624, -.016341, -.949763, .013315,
-.822216, .041778, -.699967, .068984, -.588302, .093616, -.487215, .115643,
-.396703, .135045, -.316797, .151963, -.247509, .166460, -.188854, .178595,
-.138709, .188860, -.096548, .197383, -.061845, .204319, -.034139, .210100,
-.015281, .220598, -.005219, .233367, -.000445, .246068, .000721, .256873,
.000000, .265000, -.002027, .272769, -.006659, .282408, -.015222, .292658,
-.028678, .301316, -.049571, .305212, -.077167, .301437, -.111631, .296414,
-.153549, .290510, -.203471, .283787, -.261955, .276448, -.331176, .268639,
-.411140, .260475, -.501847, .252072, -.603281, .243275, -.715436, .234095,
-.838327, .224738, -.966606, .215551, -1.100264, .206485, -1.239297, .197466,
-1.383695, .188407, -1.533458, .179266, -1.688577, .169920, -1.849044, .160238,
-2.009501, .150415, -2.169945, .140350, -2.330371, .130006, -2.490772, .119304,
THKMAX= .467515,
LEPNT= -5.292597, -.244590,
TEPNT= .000000, .265000,
NMLN/MLNPTS=
-5.292597, -.244590, -5.115757, -.261703, -4.938450, -.268945, -4.760843, -.268410,
-4.583318, -.264852, -4.405868, -.258385, -4.228518, -.249638, -4.051274, -.239016,
-3.874137, -.226703, -3.697109, -.212925, -3.520188, -.197846, -3.343371, -.181582,
-3.166655, -.164263, -2.990037, -.145972, -2.813514, -.126788, -2.637080, -.106794,
-2.460734, -.086049, -2.284471, -.064605, -2.108287, -.042519, -1.932180, -.019832,
-1.756144, .003403, -1.580176, .027143, -1.404273, .051367, -1.228436, .076062,
-1.052664, .101209, -.876953, .126785, -.701306, .152796, -.525735, .179310,
-.350237, .206315, -.174969, .234742, .000001, .265000,
$

Fig. 5L

** Relative MACH No. based on Ideal Total Pressure at I(R,T+1) vs Mprime **
const gamma=1.4018 NSP= 49 NBB= 41 NFL= 121 LE= 41 TE= 101 TIP= 49

INLET GUIDE VANE FOR AXIAL COMPRESSOR

BACKGROUND OF THE INVENTION

Embodiments of the invention relate to vanes for use in a compressor. More particularly, embodiments of the invention relate to the shape of inlet guide vanes in an axial compressor.

Most axial compressors today have inlet guide vanes (IGVs) to modulate flow to the first stage, usually a first rotor stage, of the compressor. A variety of parameters define the shape and position of each IGV in a compressor. Among these parameters are the meanline of the IGV profile; the thickness distribution of the IGV profile; the lift coefficient, which is a multiplier of the meanline; and the stagger angle, which is the angle of the IGV relative to the axial direction of the compressor.

By varying the IGV parameters, multiple IGV profile and stagger angle combinations are possible for any given IGV exit condition, the IGV exit condition being the angle at which a gas, usually air, exits the IGV.

SUMMARY OF THE INVENTION

Examples of the invention include an inlet guide vane blade row for use in a compressor. The blade row has a plurality of inlet guide vanes. Each inlet guide vane has a meanline approximately equal to NACA standard A4K6 meanline, a thickness distribution approximately equal to NACA standard SR 63 thickness distribution, a stagger angle, and a lift coefficient between 0.0 and 0.8.

Other examples of the invention include a compressor. The compressor has a housing, a shaft, a compressor stage, and a plurality of inlet guide vanes attached to the housing. Each inlet guide vane has a meanline approximately equal to NACA standard A4K6 meanline, a thickness distribution approximately equal to NACA standard SR 63 thickness distribution, a stagger angle, and a lift coefficient between 0.0 and 0.8.

Other examples of the invention include methods of retrofitting a compressor with new inlet guide vanes, the compressor having existing inlet guide vanes and an existing inlet guide vane exit condition and the existing inlet guide vanes having an existing lift coefficient. The methods include designing the new inlet guide vanes such that the new inlet guide vanes have an exit condition substantially equal to the existing inlet guide vane exit condition, and the new inlet guide vanes have a new lift coefficient less than the existing lift coefficient. The methods further include removing the existing inlet guide vanes from the compressor; and installing the new inlet guide vanes in the compressor.

These and other features of the invention will be readily apparent to those skilled in the art upon reading this disclosure in connection with the attached drawing figures.

BRIEF DESCRIPTION OF THE DRAWINGS

FIGS. 5A–5L are a printout of profile information for an example of a guide vane in accordance with embodiments of the invention;

DETAILED DESCRIPTION OF THE INVENTION

Figure 1:
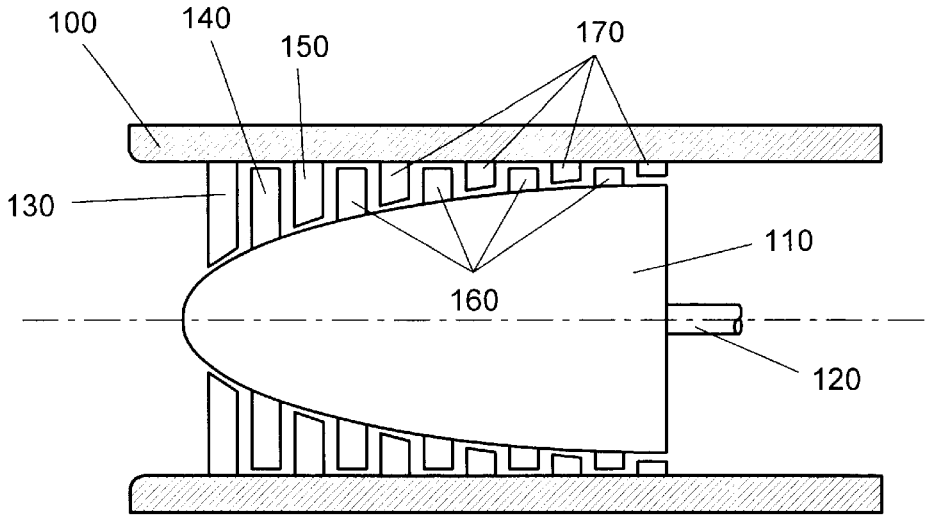
FIG. 1 is a partial sectional view of an example of an axial compressor in accordance with embodiments of the invention.

FIG. 1 is a partial sectional view of an example of an axial compressor in accordance with the invention. The compressor of FIG. 1 has a housing 100 to which IGVs 130, first stator row 150, and a plurality of stator rows 170 are attached. Hub 110 is attached to shaft 120, both of which rotate about a centerline of shaft 120. First rotor row 140 and a plurality of rotor rows 160 are attached to hub 110 and rotate therewith. In particular embodiments, IGVs 130 are movable during operation to achieve varying IGV angles.

As minor changes in the IGV parameters can result in substantial changes in the efficiency with which the IGVs turn the compressor inlet air, optimization of the IGV parameters can result in a significant increase in compressor performance.

Certain existing compressors were found to be operating at less than optimal efficiency due to less than optimal incidence loading at the IGVs. It was discovered that negative incidence results in incidence loading (losses resulting from inefficient turning of air flow) and that removing some of the negative incidence from the IGVs results in increased compressor airflow and efficiency (discussed further below with reference to FIGS. 7–12). One way in which the incidence loading can be optimized is to change the inlet angle of the IGVs, often referred to as "IGV angle".

Figure 2:
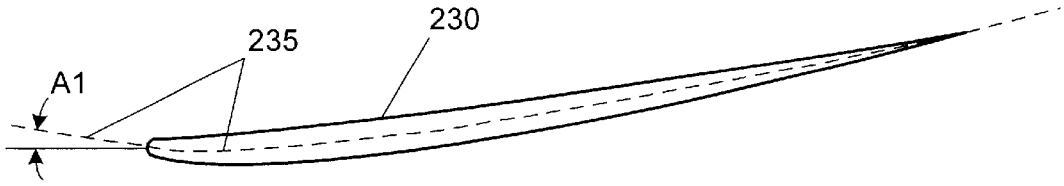
FIG. 2 is a profile of a related guide vane.
Figure 3:
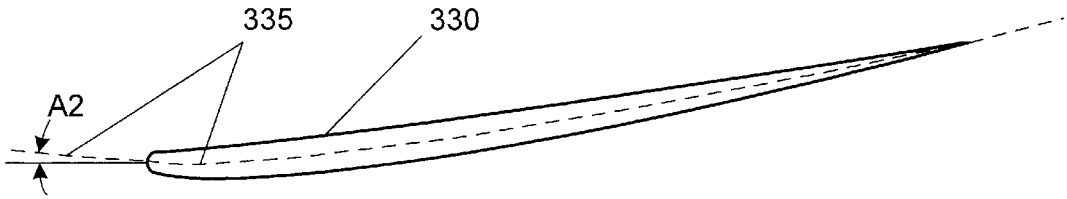
FIG. 3 is an example of a profile of a guide vane in accordance with embodiments of the invention.

FIG. 2 shows the profile and position of IGV 230 having meanline 235 positioned such that the inlet angle relative to the axial direction of the compressor is A1. FIG. 3 shows the profile and position of IGV 330 having meanline 335 and angle A2. As can be seen from FIGS. 2 and 3, angle A2 is reduced as compared to angle A1. In this example, A1 is approximately 9° and A2 is approximately 3°.

In the example shown in FIGS. 2 and 3, IGV 230 and IGV 330 have the same meanline, for example, National Advisory Committee for Aeronautics (NACA) meanline A4K6, but have different lift coefficients. The lift coefficient is a unitless multiplier of the meanline and determines the amount of bow or camber in the IGV profile. In this example, IGV 230 and IGV 330 have the same thickness distribution, for example the NACA series 63 (SR63) thickness distribution. IGV 330 has, for example, a lift coefficient of 0.4 and IGV 230 has, for example, a lift coefficient of 0.8. It was discovered that a lift coefficient of 0.4 results in less loss than a lift coefficient of 0.8. It is also believed that lift coefficients greater than 0.0 and less than 0.8 would result in improved efficiency compared to a lift coefficient of 0.8 for the example IGVs discussed above.

Figure 4:
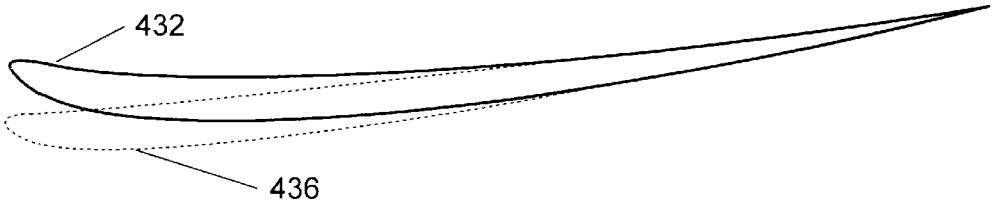
FIG. 4 shows an example of a comparison of two profiles.

FIG. 4 shows an IGV 432 having a given lift coefficient superimposed on an IGV 436 having a larger lift coefficient and more camber. FIG. 4 shows that IGV 432 and IGV 436 have the same trailing edge to help maintain the same IGV exit conditions.

FIGS. 5A–5L show coordinates for an example of a IGV of the invention that has been shown to provide improved efficiency as compared to existing IGVs in an existing compressor.

In the case of an existing compressor, new IGVs can be designed to more efficiently turn the inlet air while still maintaining the IGV exit conditions (including air flow direction) of the original IGVs. It is important to maintain the IGV exit conditions of the original IGVs in order to avoid having to redesign and replace the compressor stages down stream of the IGVs.

The efficiency and output of an existing compressor can be increased by retrofitting the IGVs of the invention to the compressor.

Figure 6:
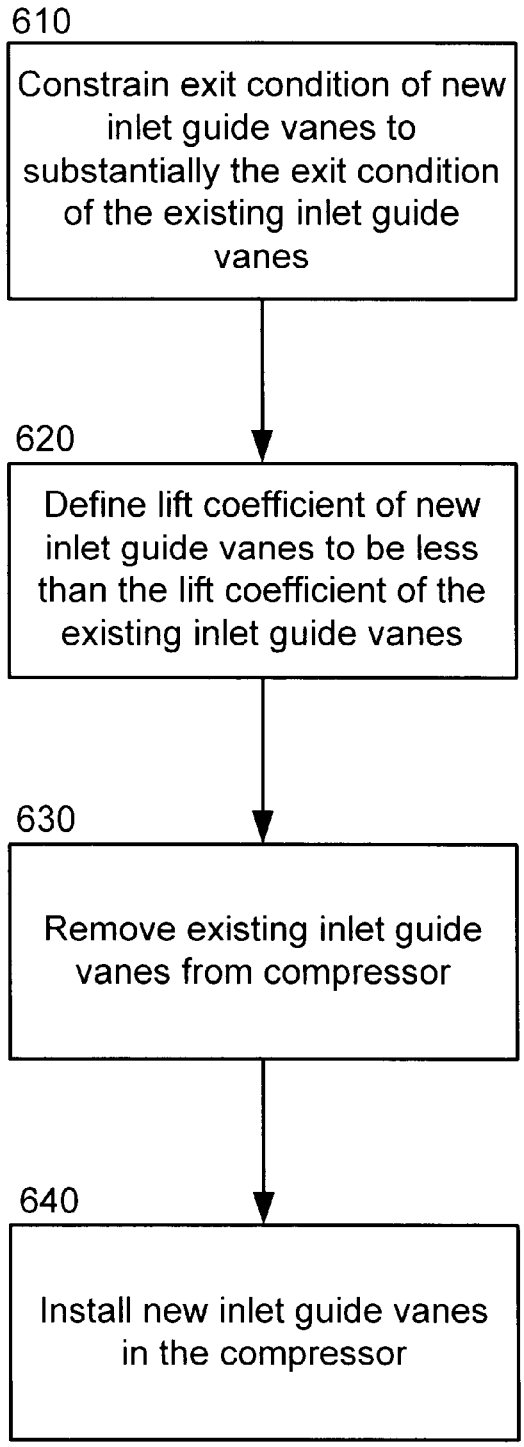
FIG. 6 is a flow chart showing an example of a method of the invention.

An example of a method of retrofitting IGVs to an existing compressor is shown in FIG. 6. In 610, the exit condition of the new IGVs are constrained to substantially equal the exit condition of the existing IGVs. This, as stated above, is to avoid having to redesign and replace the compressor stages down stream of the IGVs. In 620, the lift coefficient of the new IGVs is defined to be less than the lift coefficient of the existing IGVs. In 630, the existing IGVs are removed from the compressor and, in 640, the new IGVs are installed in the compressor.

Figure 7:
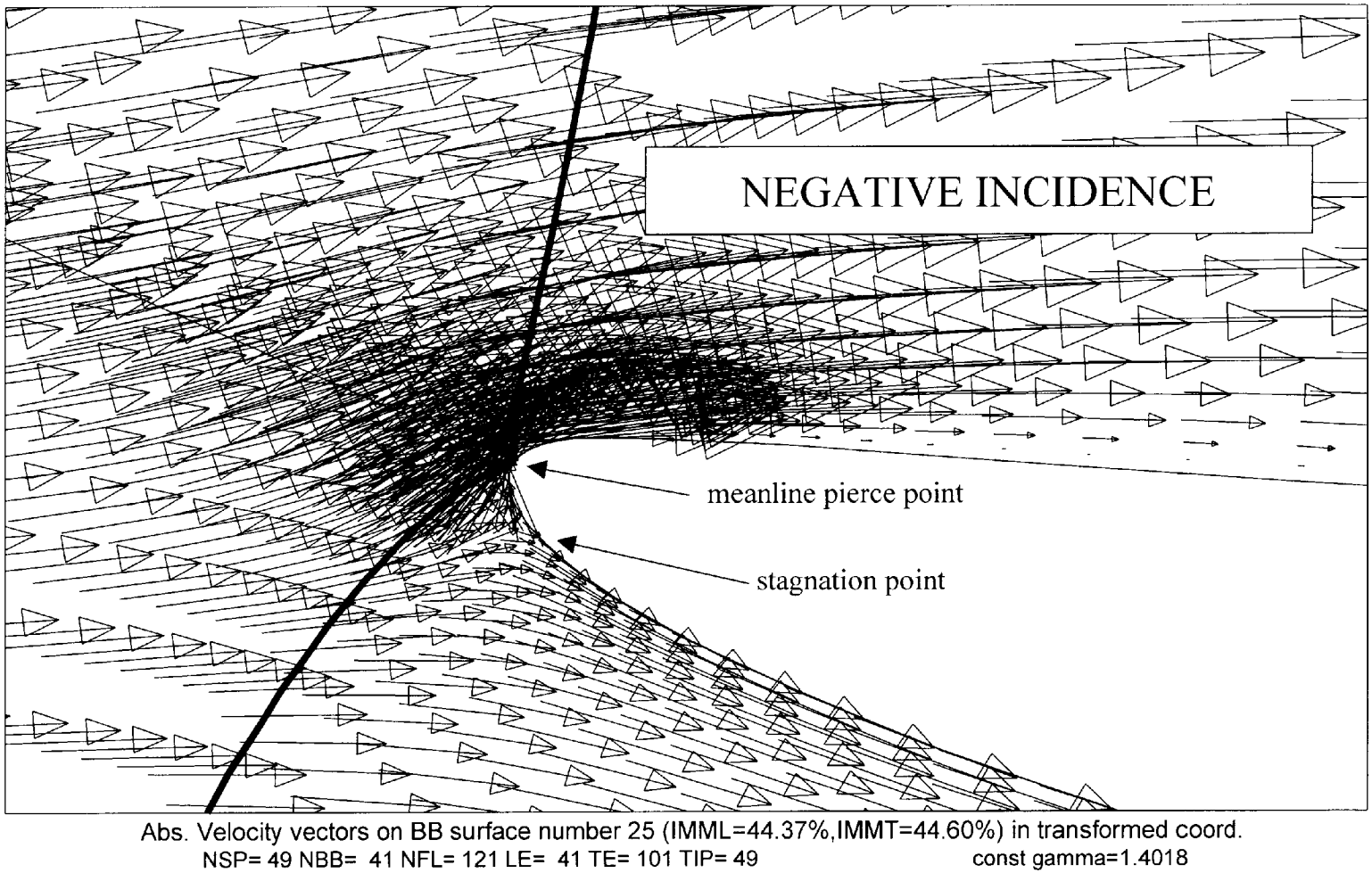
FIG. 7 shows an example of velocity vectors associated with a IGV having negative incidence.

Examples of the impact of incidence on flow are shown in FIGS. 7–10. FIG. 7 shows an example of velocity vectors on an IGV having negative incidence. It can be seen in FIG. 7 that the stagnation point of the flow is on the suction surface of the IGV below the meanline pierce point. The meanline pierce point being defined as the point that the IGV profile meanline intersects the leading edge of the IGV. The stagnation of the flow at the stagnation point is illustrated by the very small arrow head size of the velocity vectors at that point. In addition, FIG. 7 illustrates the very high velocities (indicated by the velocity vectors having large arrow heads) experienced on the pressure surface side of the meanline pierce point. The wide range of velocities shown in the example of FIG. 7 illustrate the inefficiencies associated with negative incidence.

Figure 8:
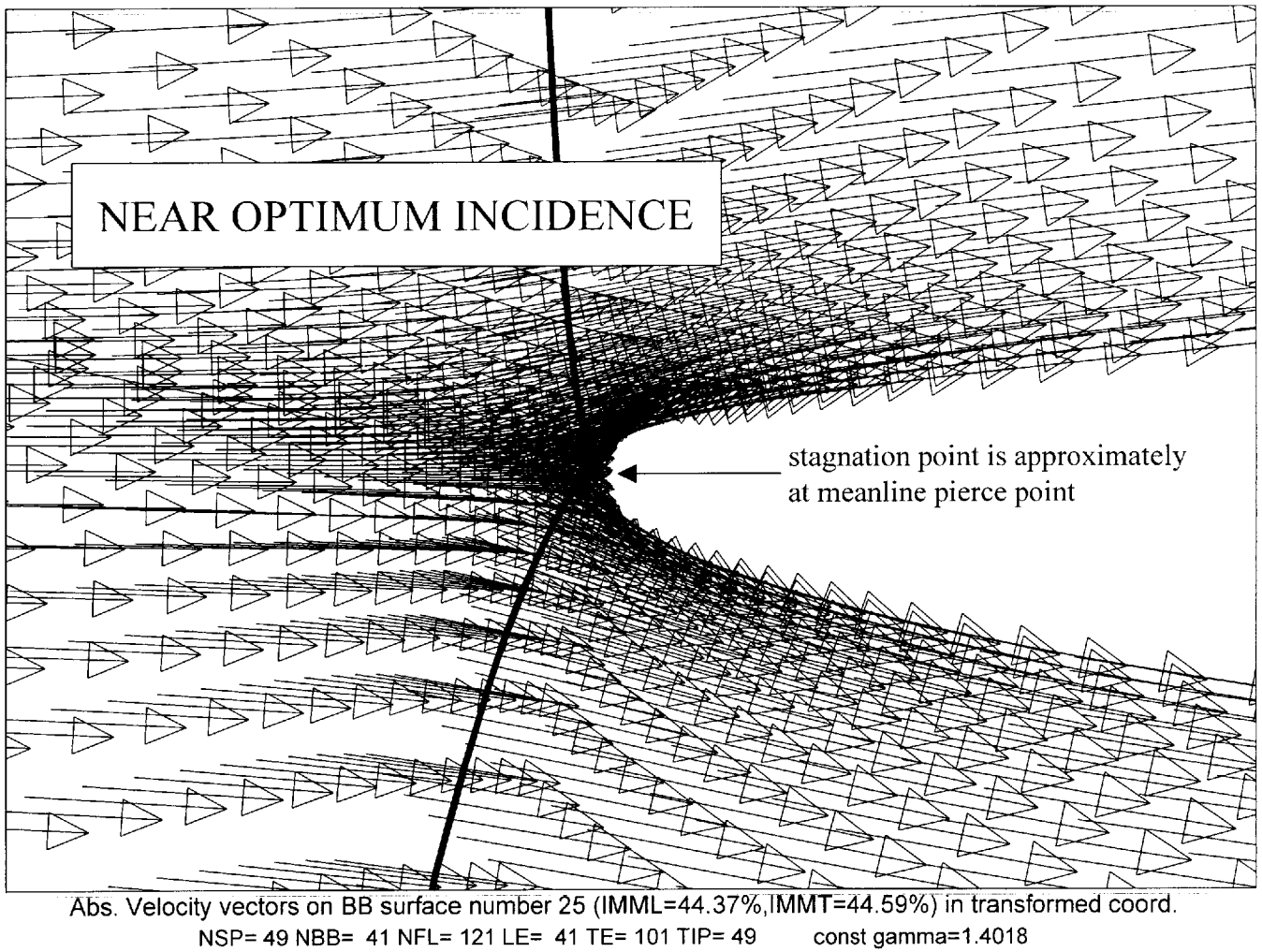
FIG. 8 shows an example of velocity vectors associated with a IGV having near optimum incidence.

FIG. 8 shows an example of near optimum incidence. In comparing FIG. 8 to FIG. 7, it can be seen that the range of velocities in FIG. 8 is smaller than the range of velocities in FIG. 7. Because there is less deceleration and acceleration of the flow in the example of FIG. 8 as compared to the example of FIG. 7, FIG. 8 illustrates a more efficient IGV. This efficiency results from the stagnation point being approximately at the meanline pierce point, or at least closer the meanline pierce point than in the example shown in FIG. 7.

Figure 9:
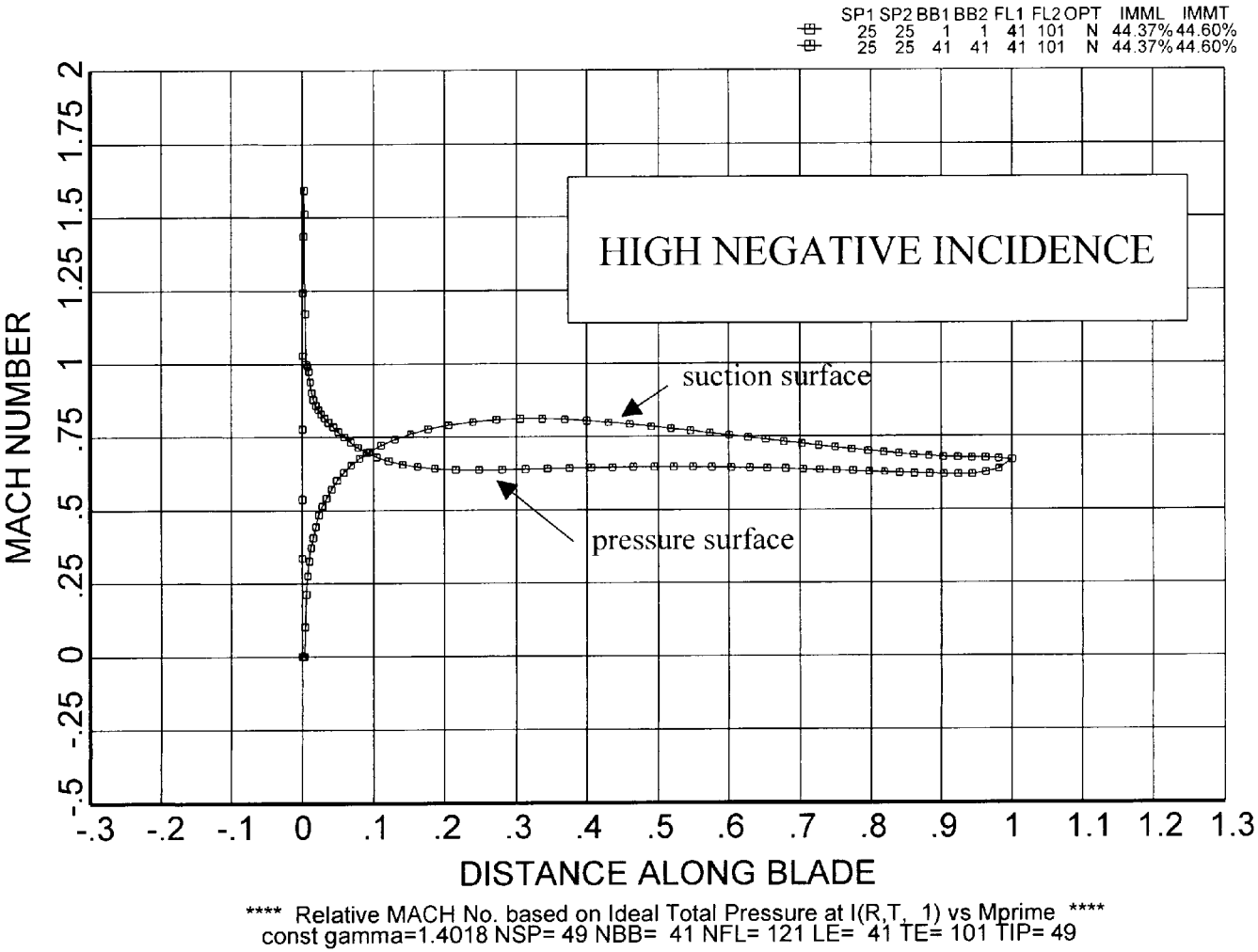
FIG. 9 shows an example of mach number vs. the distance along the blade of a IGV having high negative incidence.
Figure 10:
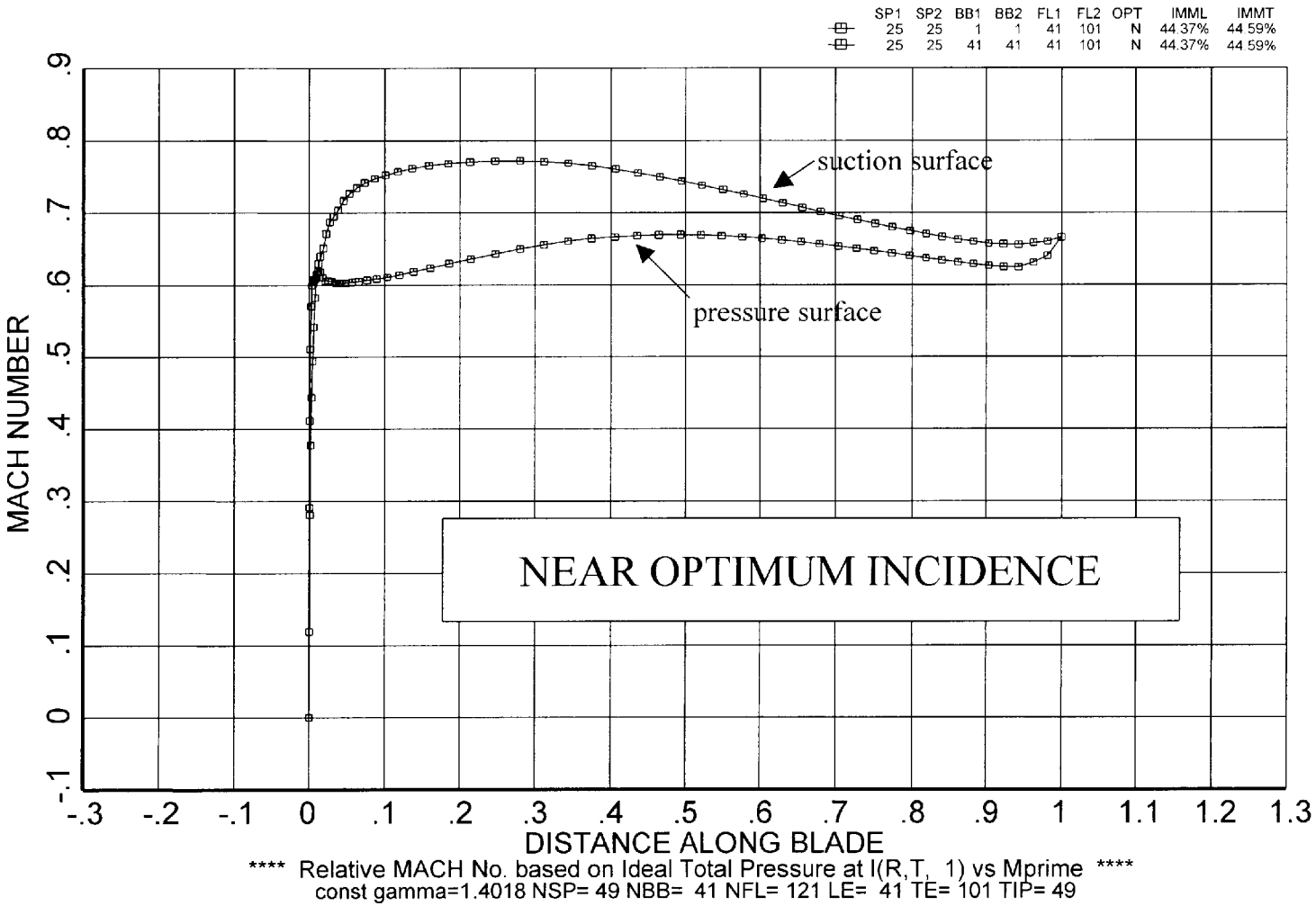
FIG. 10 shows an example of mach number vs. the distance along the blade of a IGV having near optimum incidence.

FIGS. 7 and 8 show the mach number of the flow over an IGV versus the distance along the blade of the IGV for IGVs having high negative incidence and near optimum incidence, respectively. FIG. 9 illustrates the large range (approximately 0 to mach 1.6) of flow velocities experienced in a high negative incidence situation such as, for example, that shown in FIG. 7. In contrast, FIG. 10 shows a velocity range of 0 to approximately mach 0.77 for an IGV having near optimum incidence such as, for example, the IGV shown in FIG. 8.

Figure 11:
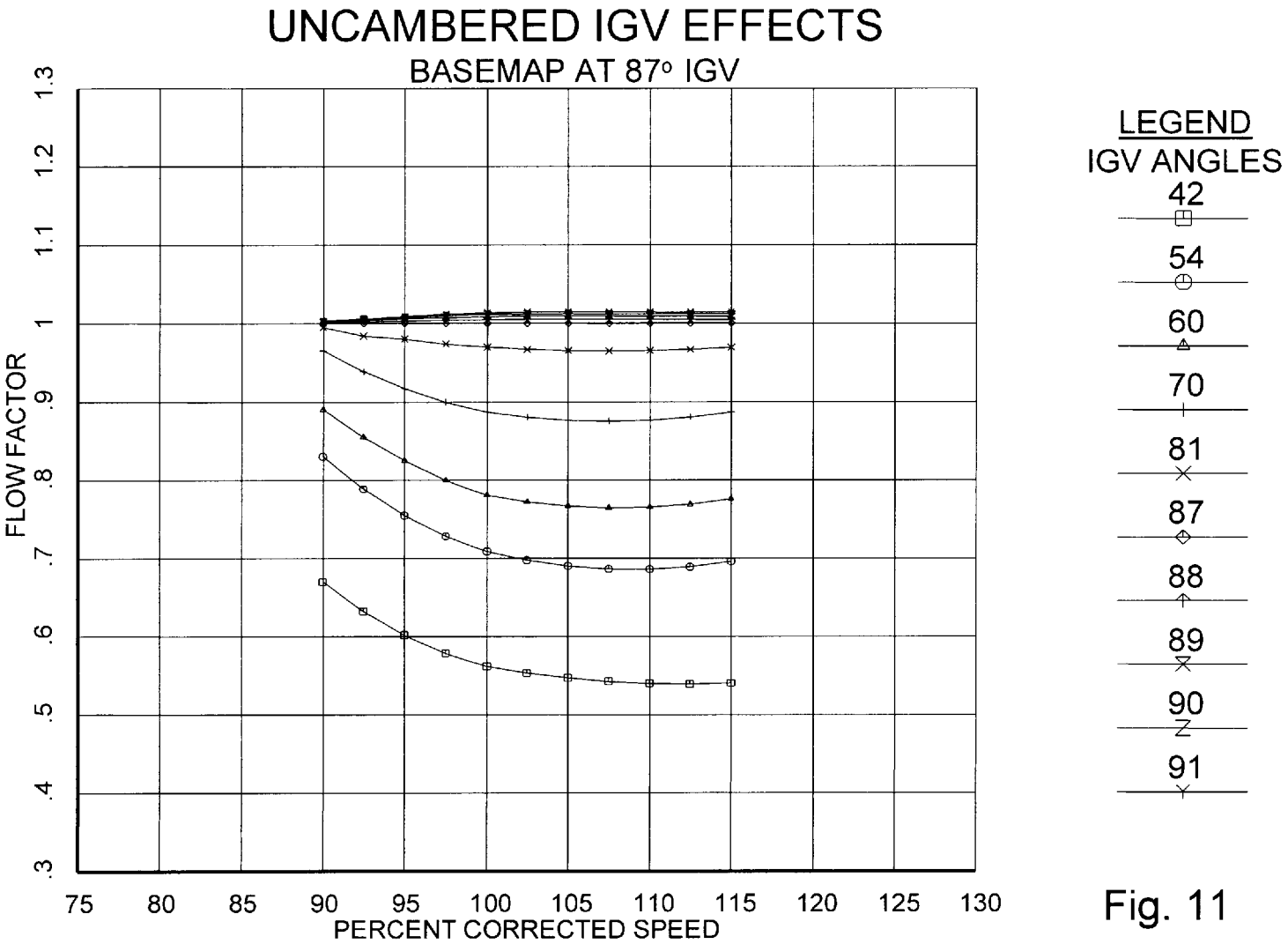
FIG. 11 shows an example of flow factor vs. percent corrected speed for an uncambered IGV.
Figure 12:
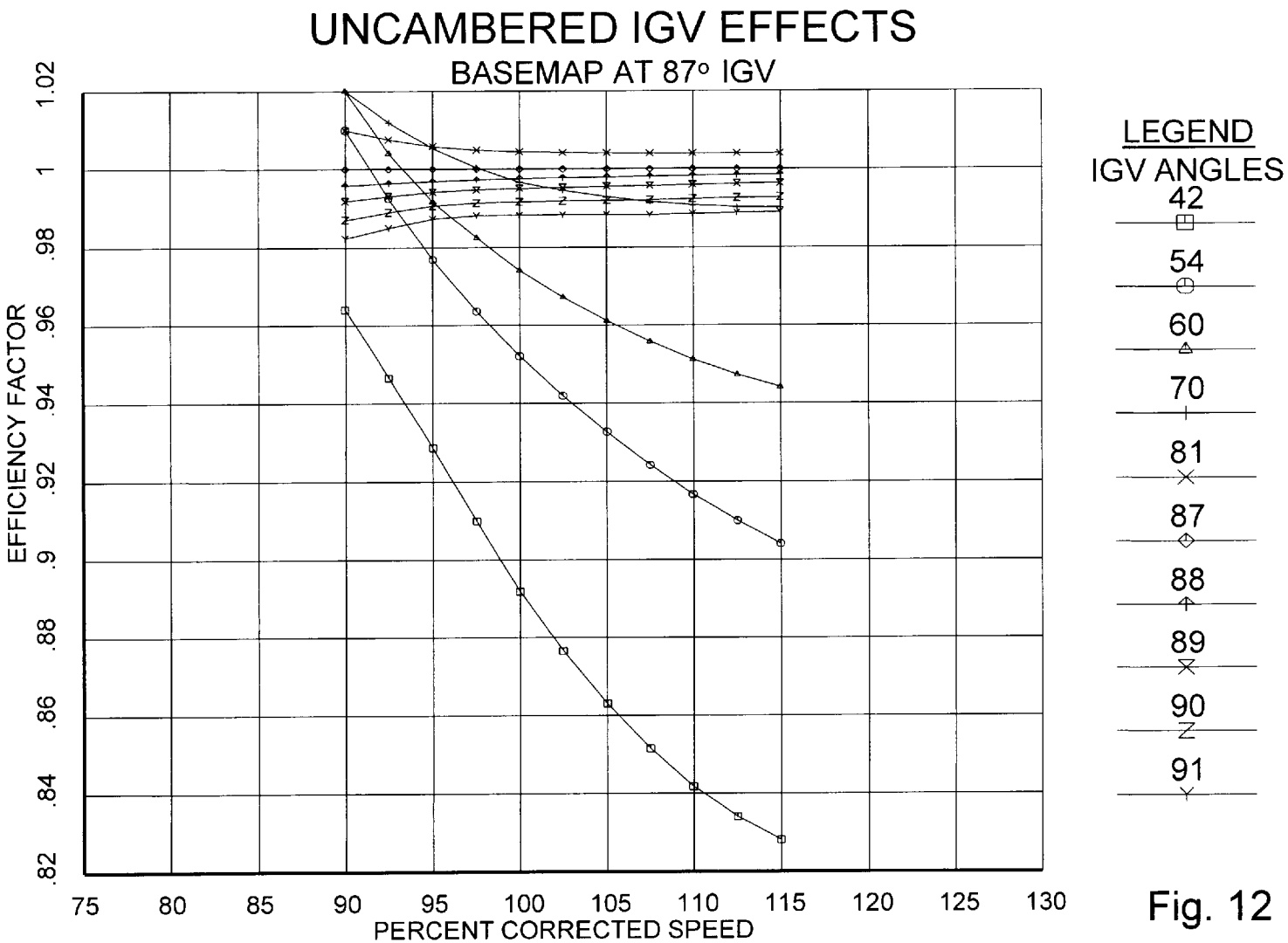
FIG. 12 shows an example of efficiency factor vs. percent corrected speed for an uncambered IGV.

FIGS. 11 and 12 show the flow factor and efficiency factor, respectively, versus percent corrected speed of the shaft of the compressor. As indicated, the flow factor and efficiency factor are relative to the base map at an IGV angle, or stagger angle, of 87°. As shown in the legends, plots are shown for various IGV angles between 42° and 91°. FIGS. 11 and 12 can be used in conjunction with the 87° base map to determine maps for IGV angles between 42° and 91°.

While the invention has been described with reference to particular embodiments and examples, those skilled in the art will appreciate that various modifications may be made thereto without significantly departing from the spirit and scope of the invention.

What is claimed is:

1. An inlet guide vane blade row for use in a compressor, the blade row comprising:

a plurality of inlet guide vanes, each inlet guide vane having a meanline approximately equal to NACA standard A4K6 meanline, a thickness distribution approximately equal to NACA standard SR 63 thickness distribution, a stagger angle, and a lift coefficient between 0.0 and 0.8.

2. The blade row of claim 1, wherein the lift coefficient is between 0.0 and 0.7.

3. The blade row of claim 2, wherein the lift coefficient is between 0.0 and 0.6.

4. The blade row of claim 3, wherein the lift coefficient is between 0.0 and 0.5.

5. The blade row of claim 4, wherein the lift coefficient is approximately 0.4.

6. The blade row of claim 5, wherein the meanline is equal to the NACA standard A4K6 meanline.

7. The blade row of claim 6, wherein the thickness distribution is equal to the NACA standard SR 63 thickness distribution.

8. The blade row of claim 7, wherein the stagger angle is approximately 87 degrees.

9. The blade row of claim 4, wherein the lift coefficient is between 0.0 and 0.4.

10. The blade row of claim 1, wherein the meanline is equal to the NACA standard A4K6 meanline.

11. The blade row of claim 10, wherein the thickness distribution is equal to the NACA standard SR 63 thickness distribution.

12. The blade row of claim 11, wherein the stagger angle is approximately 87 degrees.

13. The blade row of claim 1, wherein the thickness distribution is equal to the NACA standard SR 63 thickness distribution.

14. A compressor, comprising:

a housing;

a shaft;

a compressor stage; and a plurality of inlet guide vanes attached to the housing, each inlet guide vane having a meanline approximately equal to NACA standard A4K6 meanline, a thickness distribution approximately equal to NACA standard SR 63 thickness distribution, a stagger angle, and a lift coefficient between 0.0 and 0.8.

15. The compressor of claim 14, wherein the lift coefficient is between 0.0 and 0.7.

16. The compressor of claim 15, wherein the lift coefficient is between 0.0 and 0.6.

17. The compressor of claim 16, wherein the lift coefficient is between 0.0 and 0.5.

18. The compressor of claim 17, wherein the lift coefficient is approximately 0.4.

19. The compressor of claim 18, wherein the meanline is equal to the NACA standard A4K6 meanline.

20. The compressor of claim 19, wherein the thickness distribution is equal to the NACA standard SR 63 thickness distribution.

21. The compressor of claim 20, wherein the stagger angle is approximately 87 degrees.

22. The compressor of claim 17, wherein the lift coefficient is between 0.0 and 0.4.

23. The compressor of claim 14, wherein the meanline is equal to the NACA standard A4K6 meanline.

24. The compressor of claim 23, wherein the thickness distribution is equal to the NACA standard SR 63 thickness distribution.

25. The compressor of claim 24, wherein the stagger angle is approximately 87 degrees.

26. The compressor of claim 14, wherein the thickness distribution is equal to the NACA standard SR 63 thickness distribution.

27. A method of retrofitting a compressor with new inlet guide vanes, the compressor having existing inlet guide vanes and an existing inlet guide vane exit condition, the existing inlet guide vanes having an existing lift coefficient, the method comprising:

designing the new inlet guide vanes such that the new inlet guide vanes have an exit condition substantially equal to the existing inlet guide vane exit condition, and the new inlet guide vanes have a new lift coefficient less than the existing lift coefficient;

removing the existing inlet guide vanes from the compressor; and installing the new inlet guide vanes in the compressor in place of the existing inlet guide vanes.

28. The method of claim 27, wherein the new inlet guide vanes have a meanline substantially equal to a meanline of the existing inlet guide vanes.

29. The method of claim 28, wherein the meanline of the new inlet guide vanes is equal to the NACA standard A4K6 meanline.

30. The method of claim 29, wherein the new inlet guide vanes have a stagger angle, and the stagger angle is approximately 87 degrees.

31. The method of claim 27, wherein the new inlet guide vanes have a thickness distribution, the thickness distribution being equal to the NACA standard SR 63 thickness distribution.

32. The method of claim 27, wherein the new lift coefficient is between 0.2 and 0.6.

33. The method of claim 32, wherein the new lift coefficient is approximately 0.4.

34. The method of claim 33, wherein the new inlet guide vanes have a stagger angle, and the stagger angle is approximately 87 degrees.

35. The method of claim 29, wherein the new inlet guide vanes have a thickness distribution, the thickness distribution being equal to the NACA standard SR 63 thickness distribution.

36. The method of claim 35, wherein the new lift coefficient is between 0.2 and 0.6.

* * * * *